United States Patent [19]

Garrett

[11] Patent Number: 4,754,708

[45] Date of Patent: Jul. 5, 1988

[54] PROJECTILE DRIVING BAND RETENTION SYSTEM

[75] Inventor: Harold E. Garrett, Santa Ana, Calif.

[73] Assignee: Ford Aerospace & Communications Corp., Dearborn, Mich.

[21] Appl. No.: 934,525

[22] Filed: Nov. 24, 1986

[51] Int. Cl.[4] ..... F42B 31/00

[52] U.S. Cl. ..... 102/527

[58] Field of Search ..... 102/524–527

[56] References Cited

U.S. PATENT DOCUMENTS

| | | | |
|---|---|---|---|
| 681,448 | 8/1901 | Gathmann | 102/526 |
| 805,556 | 11/1905 | Johnson | 102/526 |
| 2,386,054 | 10/1945 | McGee | 102/524 |
| 2,996,012 | 8/1961 | Butler | 102/527 |
| 3,301,186 | 1/1967 | Henry | 102/526 |
| 4,520,731 | 6/1985 | Gotz et al. | 102/527 |

*Primary Examiner*—Harold J. Tudor

*Attorney, Agent, or Firm*—Peter Abolins; Keith L. Zerschling

[57] ABSTRACT

An ammunition round has a plastic molded driving band on a projectile. The driving band is mechanically attached to the projectile by opposing curved hooks bent toward one another and defining a restraining area therebetween. The seating area for the driving band has a plurality of pairs of such hooks circumferentially and longitudinally displaced from one another.

1 Claim, 2 Drawing Sheets

PROJECTILE DRIVING BAND RETENTION SYSTEM

STATEMENT OF GOVERNMENT INTEREST

The U.S. government has a paid-up license in this invention and the right in limited circumstances to require the patent owner to license others on reasonable terms as provided for by the terms of an Air Force contract.

BACKGROUND OF THE INVENTION

1. Field of the Invention

This invention relates to a projectile of an ammunition round and, in particular, to the attachment of a driving band to the projectile.

2. Prior Art

Driving bands on projectiles are slightly radially enlarged portions of the projectile which act to obturate the barrel thus providing a seal so that the expanding gases from the firing of the ammunition round can drive the projectile through the barrel. Further, the driving band is engraved through interference with the rifling and causes the projectile to spin. This acts to stabilize the projectile so that it may be propelled accurately.

It is known to use copper or soft iron bands for such driving bands but these tend to wear the barrel quickly. The use of plastic for driving bands is also known. However, there has been difficulty in attaching these plastic driving bands to the projectile. One known relatively expensive method is to spray a porous metal onto the projectile and then mold the plastic in place. The plastic would tend to interlock with the porous metal so as to secure the plastic to the projectile. This interlock is hard to obtain. The interlock cannot be relied upon due to variability of processing parameters. Such processing parameters include having sufficient porosity in the sprayed-on metal so the plastic can be received. Also, the use of sprayed-on metal requires an additional interface that can separate from the projectile. The uniformity and reliability of the interlock cannot be readily verified without destructive testing.

Some bands have been secured to the projectile body through the use of various dovetail configurations in the projectile body. Such configurations require a band depth of approximately 0.050 inch. This is a significant disadvantage in the design of a projectile body because the wall thickness at the band area of the projectile body must be increased. This adds to the weight of the projectile and reduces the amount of explosive that can be stored inside the projectile body. Attempts were made to solve this problem by using either a metal sprayed surface or a wire mesh attached to the projectile to provide a porous surface for retention of the driving bands. Neither of these approaches were fully successful due to failure of either the primary or secondary attachments, or an inability to verify consistency of the attachments.

There still remains a need for a simple, secure mechanical coupling of the driving band to the projectile. In accordance with this invention, driving bands are able to perform at higher velocities and withstand the more harsh environment of telescoped ammunition. Other systems used in the past (copper bands, soft iron bands, plastic bands with deep dovetails, etc.) will not perform adequately in this environment at shallow seat depths.

SUMMARY OF THE INVENTION

This invention includes an ammunition round having a projectile with a plastic driving band molded onto opposing curved hooks which are integral with the projectile. Advantageously, the curved hooks are formed by forming longitudinal ridges along the length of the projectile region to which the driving band is to be coupled. Then pairs of ridges are bent toward one another to form the opposing curved hooks and an intermediate restraining area. Longitudinally adjacent portions of each ridge are bent in opposing direction so that longitudinally adjacent restraining areas are circumferentially displaced from one another. The result is a checker board pattern when viewed in plan which provides a uniform, verifiable and predictable area of mechanical coupling between the projectile and the driving band.

The method and structure for attaching plastic driving bands to a projectile uses a mechanical design that is an integral part of the projectile body. Thus, the possibility of failure of a secondary attachment is eliminated. Further, this design permits a significantly shallower band seat depth in the projectile body. This shallower band seat saves weight and allows more space for explosives. It can be readily appreciated that the deeper the band seat must go in towards the center of the projectile, the less room there is in the interior for explosives.

DETAILED DESCRIPTION OF THE INVENTION

Figure 1:
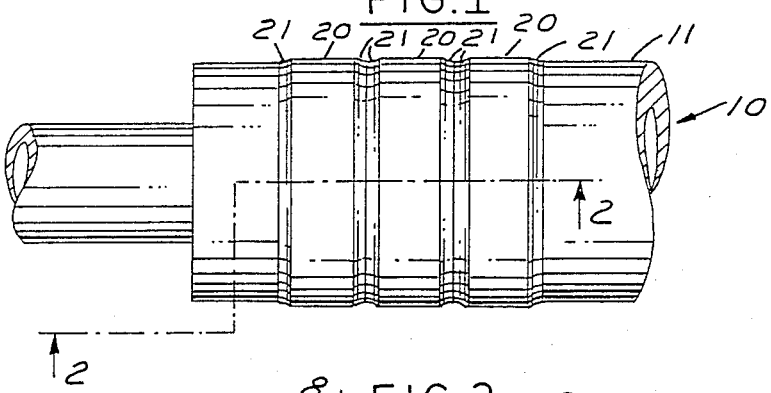
FIG. 1 is a side view, partly broken, of a projectile including mounted driving bands.

Referring to FIG. 1, a projectile 10 includes three circumferential plastic driving bands 20 with side or edge restraints 21. Typical materials for projectile 10 include steel and various steel alloys. A typical material for driving band 20 is a plastic such as polyethersulfone. Driving bands 20 are molded in place on driving band seats 22.

Figure 2:
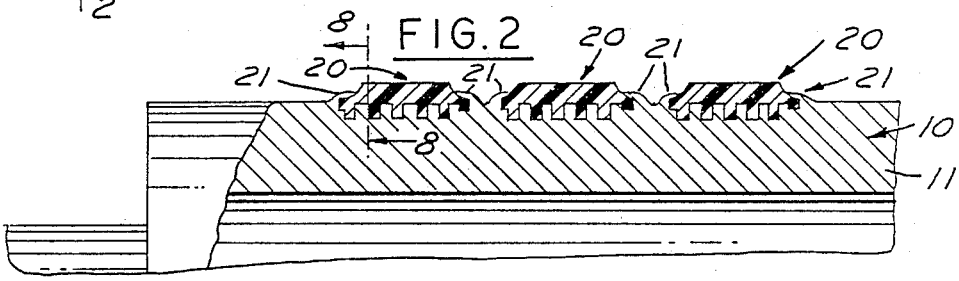
FIG. 2 is a cross-section area through a portion of FIG. 1 including a cross-section of the driving bands.

Driving bands 20 are attached using an integral part of a projectile body 11 and require, for example, a driving band seat 22 depth of only about 0.018 inch. In addition to edge restraints 21, driving bands 20 are secured by the use of mechanical bottom restraints that are part of projectile body 11. Sequential metal forming operations provide side support edge restraints 21 and driving band seats 22 that fill up with plastic during molding. This mechanical retention is resistant to band failure due to band deformation at high velocity initial engagement of the band with the rifling that engraves the band, applies sheer loads, and subsequently centrifugal forces during projectile firing. Referring to FIG. 2, a cross-section shows the in-place molded plastic driving band 20 secured to seat 22 by a curved prong mechanism explained further below and secured on its sides by curved edge restraints 21.

Figure 3:
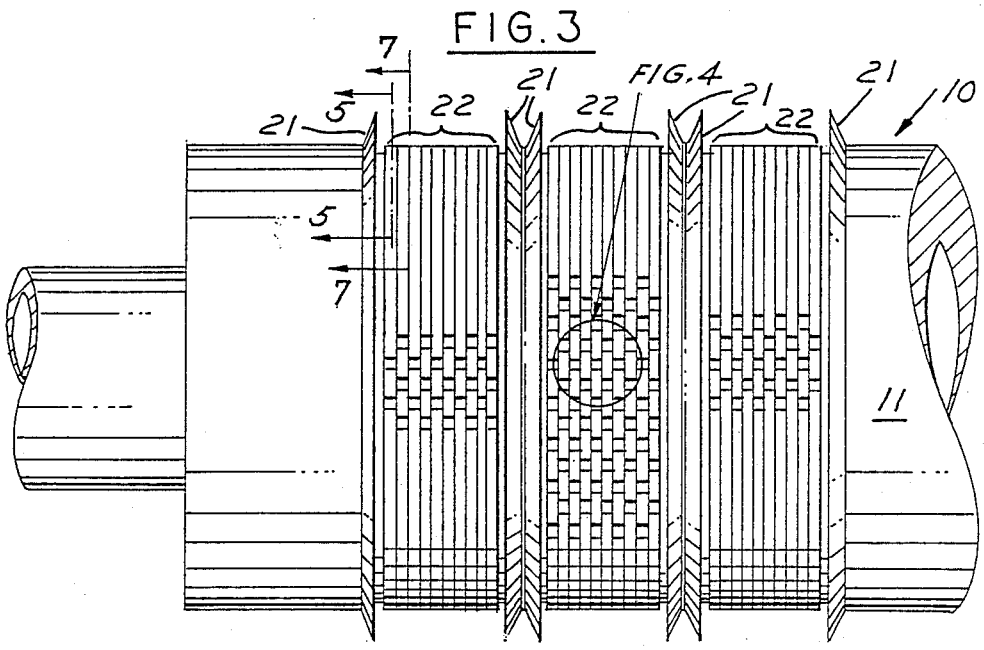
FIG. 3 is a plan view of a partially fabricated driving band seat of a projectile including a region of a checker board pattern with opposing curved hooks.
Figure 4:
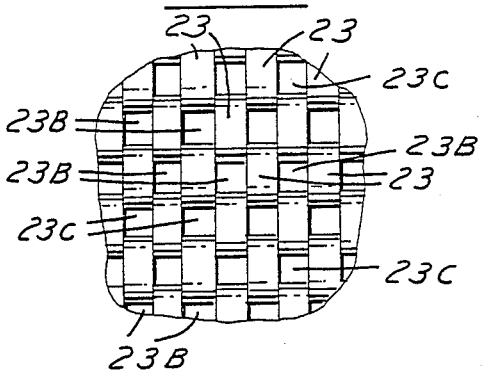
FIG. 4 is an enlarged view of a portion of the checker board pattern of FIG. 3.
Figure 9:
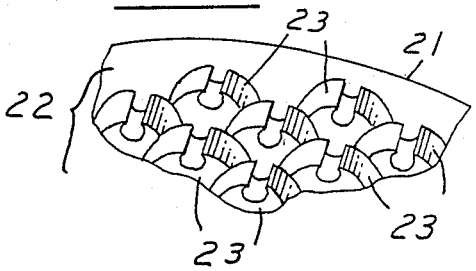
FIG. 9 is a perspective view of the checker board pattern of FIG. 4 in a direction parallel to the original ridges.

Referring to FIG. 3, projectile 10 is shown before the in-place molding of plastic driving bands 20. The circumferential edge restraints 21 are in an unbent condition ready to be bent prior to the molding of plastic driving bands 20. Seat region 22, between edge guards 21, contains a plurality of alternating hooks 23. As further discussed below, alternating hooks 23 are bent toward each other. Hooks 23, formed in a portion of seating area 22 of FIG. 3, are shown in enlarged plan view in FIG. 4, and in perspective view in FIG. 9.

Figure 5:
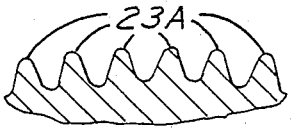
FIG. 5 is a section view along line 5—5 of FIG. 3 of longitudinal ridges which have been formed in a projectile band seat, before the ridges have been bent.
Figure 6:
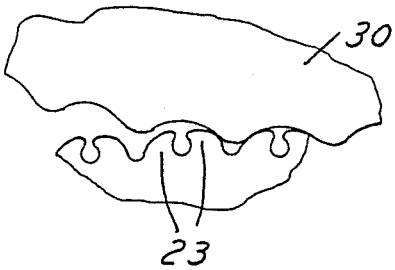
FIG. 6 shows the knurling process whereby adjacent ridges are bent toward each other to form an intervening restraining area.
Figure 7:
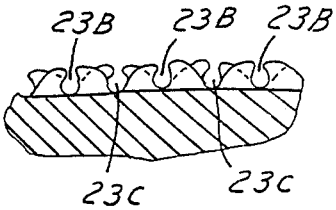
FIG. 7 is a section view along line 7—7 of FIG. 3 showing that longitudinally adjacent portions of the ridges have been bent in opposite directions so that the plurality of restraining areas along the side of any one ridge are located on alternate sides along the length of the ridge.

Referring to FIG. 5, to form hooks 23, longitudinal ridges 23A are first formed. Ridges 23A have a symmetric peak shape with intermediate valleys. typically, a knurling operation is used to form the rides and valleys. Referring to FIG. 6, a knurling tool 30 is applied to ridges 23A of FIG. 5 to produce curved ridges which bend toward each other with an intermediate restraining area. Advantageously, knurling tool 30 is shaped so that adjacent portions along the length of ridges 23A are bent in opposing directions as shown in FIG. 7. This can be accomplished by having a relatively thin disc-like knurling tool which is sequentially shifted along the length of a ridge 23A and then rolled to deform a portion of ridge 23A, or having a larger knurling tool with a plurality of longitudinally stacked, circumferentially displaced discs so that one rolling pass across ridges 23A bends sections of the entire length of ridges 23A in opposing directions.

Figure 8:
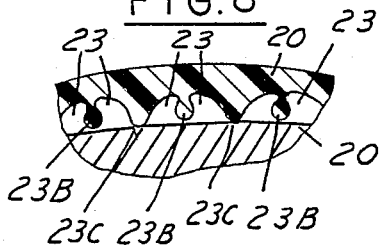
FIG. 8 is a cross-section view along section line 8—8 of FIG. 2 showing a molded driving band secured by opposing curved hooks with intermediate restraining areas.

Referring to FIG. 7, the area intermediate adjacent hooks 23 which are bent toward each other is a region 23B for providing interlocking restraint of the molded plastic band 20. In FIG. 8, the flow of plastic into the retaining areas 23B is shown and a cross-section of a finished driving band 20 illustrated. The region between adjacent ridges which are bent away from each other is designated as 23C.

Various modifications and variations will no doubt occur to those skilled in the various arts to which this invention pertains. For example, the particular width of the driving bands and size and shape of the hook pattern, and/or edge restraint configuration, may be varied from that disclosed herein. These and all other variations which basically rely on the teachings through which this disclosure has advanced the art are properly considered within the scope of this invention.

I claim:

1. An ammunition round includes:

an elongated projectile with a circumferential plastic driving band molded onto hook means which are integral with and protruding from said projectile, said hook means being paired so that a pair has two opposing hook means curved toward each other and define therebetween a restraining area for receiving plastic material of said driving band during a molding process, thereby securing the plastic in the restraining area and securing said driving band to said projectile;

a first plurality of pairs of opposing hook means with intermediate restraining areas positioned around a first circumference of said projectile, a second plurality of pairs of opposing hook means with intermediate restraining areas positioned around a second circumference of said projectile adjacent said first circumference, said pairs in said second plurality being circumferentially displaced from said pairs in said first plurality so that longitudinally aligned hook means along said projectile in said first and second plurality have opposing directions of curve and the restraining areas of said first plurality of pairs are circumferentially displaced from the restraining areas of said second plurality of pairs;

said hook means being positioned in a circumferential driving band seating area which is positioned between two circumferential edge restraints, separated from each other along the length of said projectile, said edge restraints acting to secure longitudinally spaced edges of said driving band;

a plurality of circumferential driving band seating areas, separated from each other in a longitudinal direction along said projectile, each driving band seating area being bounded by edge restraints, each circumferential driving band seating area including alternating first plurality and second plurality pairs of opposing hook means along the longitudinal extent of said driving band seating area on said projectile; and said driving band seating area having a depth of about 0.018 inch into said projectile.

* * * * *